US010301731B2

(12) United States Patent
Fiorucci et al.

(10) Patent No.: US 10,301,731 B2
(45) Date of Patent: May 28, 2019

(54) ELECTROLYTIC CELL FOR METAL ELECTROWINNING

(71) Applicant: INDUSTRIE DE NORA S.P.A., Milan (IT)

(72) Inventors: Alessandro Fiorucci, Origgio (IT); Alice Calderara, Agnadello (IT); Luciano Iacopetti, Milan (IT)

(73) Assignee: INDUSTRIE DE NORA S.P.A., Milan (IT)

( * ) Notice: Subject to any disclaimer, the term of this patent is extended or adjusted under 35 U.S.C. 154(b) by 239 days.

(21) Appl. No.: 14/781,472

(22) PCT Filed: Apr. 3, 2014

(86) PCT No.: PCT/EP2014/056680

§ 371 (c)(1),
(2) Date: Sep. 30, 2015

(87) PCT Pub. No.: WO2014/161928

PCT Pub. Date: Oct. 9, 2014

(65) Prior Publication Data

US 2016/0024670 A1 Jan. 28, 2016

(30) Foreign Application Priority Data

Apr. 4, 2013 (IT) ..... MI2013A0505

(51) Int. Cl.
*C25C 7/06* (2006.01)
*C25C 1/12* (2006.01)
(Continued)

(52) U.S. Cl.
CPC ..... *C25C 7/06* (2013.01); *C25C 1/12* (2013.01); *C25C 7/00* (2013.01); *C25C 7/02* (2013.01); *C25C 7/04* (2013.01)

(58) Field of Classification Search
CPC .... C25C 1/12; C25C 7/00; C25C 7/02; C25C 7/04; C25C 7/06
See application file for complete search history.

(56) References Cited

U.S. PATENT DOCUMENTS 3,029,193 A * 4/1962 Dean ..... C25C 3/26 204/246
3,899,405 A * 8/1975 Iverson ..... C02F 1/46114 205/754

(Continued)

FOREIGN PATENT DOCUMENTS

EP 0046447 2/1982
WO WO-2013037899 A1 * 3/2013 ..... C25C 7/00
WO 2013/060786 5/2013

OTHER PUBLICATIONS

International Search Report issued in PCT Application No. PCT/EP2014/056680.

(Continued)

*Primary Examiner* — Ciel P Thomas
(74) *Attorney, Agent, or Firm* — Lucas & Mercanti, LLP

(57) ABSTRACT

The invention relates to a cell for metal electrowinning equipped with a device useful for preventing the adverse effects of dendrite growth on the cathodic deposit. The cell comprises a porous conductive screen, positioned between the anode and the cathode, capable of stopping the growth of dendrites and avoiding that they reach the anode surface.

10 Claims, 1 Drawing Sheet

(51) Int. Cl.

| | |
|---|---|
| ***C25C 7/02*** | (2006.01) |
| ***C25C 7/00*** | (2006.01) |
| ***C25C 7/04*** | (2006.01) |

(56) References Cited

U.S. PATENT DOCUMENTS

| | | | | | |
|---|---|---|---|---|---|
| 4,201,653 | A | * | 5/1980 | O'Neill | C25C 7/00 204/263 |
| 4,256,557 | A | | 3/1981 | Soboroff et al. | |
| 4,517,068 | A | * | 5/1985 | Hinden | C25B 11/0484 204/282 |
| 4,776,931 | A | * | 10/1988 | Hardy | C25C 7/06 204/228.6 |
| 4,786,384 | A | | 11/1988 | Gerhardt et al. | |
| 5,622,615 | A | * | 4/1997 | Young | C22B 15/0071 205/576 |
| 6,120,658 | A | | 9/2000 | Dunn et al. | |
| 6,352,662 | B1 | | 3/2002 | Murphy et al. | |
| 2005/0067291 | A1 | * | 3/2005 | Haiki | C25C 1/12 205/111 |

OTHER PUBLICATIONS

International Preliminary Report on Patentability issued in PCT Application No. PCT/EP2014/056680.

* cited by examiner

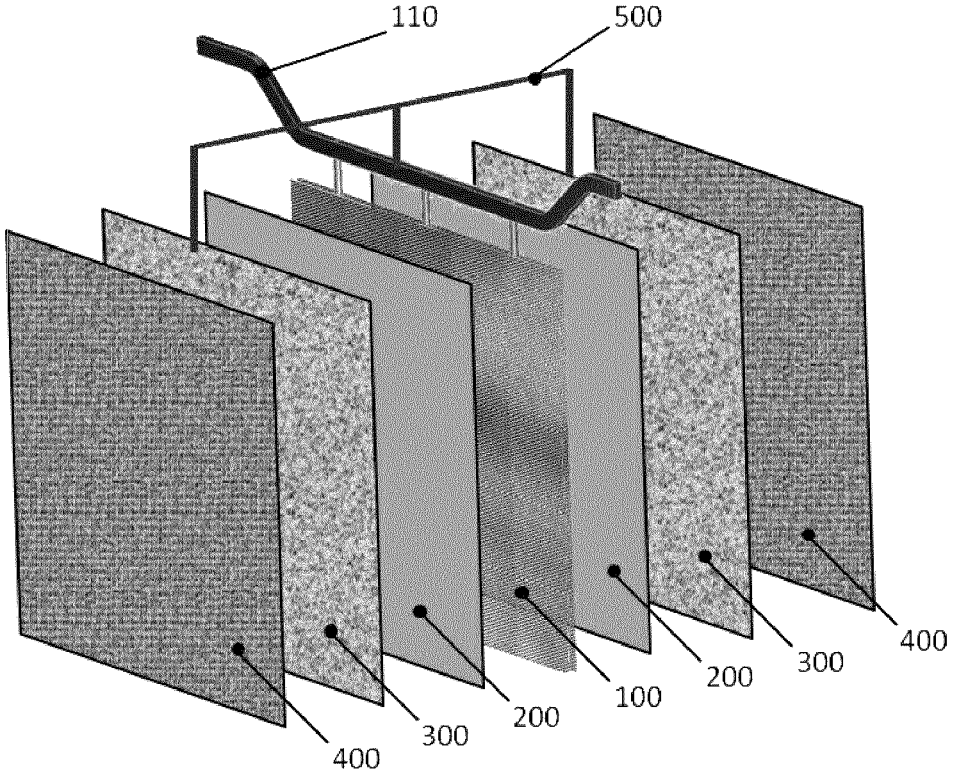
110
500
400
300
200
100
200
300
400

ELECTROLYTIC CELL FOR METAL ELECTROWINNING

CROSS-REFERENCE TO RELATED APPLICATIONS

This application is a U.S. national stage of PCT/EP2014/056680 filed on Apr. 3, 2014 which claims the benefit of priority from Italian Patent Application No. MI2013A000505 filed Apr. 4, 2013, the contents of each of which are incorporated herein by reference.

FIELD OF THE INVENTION

The invention relates to a cell for metal electrowinning, particularly useful for the electrolytic production of copper and other non-ferrous metals from ionic solutions.

BACKGROUND OF THE INVENTION

Electrometallurgical processes are generally carried out in undivided electrochemical cell containing an electrolytic bath and a multiplicity of anodes and cathodes; in such processes, such as the electrodeposition of copper, the electrochemical reaction taking place at the cathode, which is usually made of stainless steel, leads to the deposition of copper metal on the cathode surface. Normally cathodes and anodes are vertically arranged, interleaved in a face-to-face position. The anodes are fixed to suitable anodic hanger bars, which in their turn are in electrical contact with positive bus-bars integral with the cell body; the cathodes are similarly supported by cathodic hanger bars which are in contact with the negative bus-bars. The cathodes extracted at regular intervals, usually of a few days, to effect the harvesting of the deposited metal. The metallic deposit is expected to grow with a regular thickness over the entire surface of the cathodes, building up with the passage of electric current, but it is known that some metals, such as copper, are subject to occasional formation of dendritic deposits that grow locally at increasingly higher rate as that their tip approaches the surface of the facing anode; inasmuch as the local distance between anode and cathode decreases, an increasing fraction of current tends to concentrate at the point of dendrite growth, until the onset of a short-circuit condition between cathode and anode occurs. This obviously entails a loss of faradic efficiency of the process because part of the supplied current is dispersed as short-circuit current rather than being used to produce more metal. In addition, the establishment of a short-circuit condition brings about a local temperature rise in correspondence of the contact point, which in turn is the cause of damage to the anode surface. With the anodes of the older generation, made out of lead sheets, the damage is generally limited to the melting of a small area around the dendrite tip; the situation is however much more serious when present-day anodes made of catalyst-coated titanium foraminous structures such as meshes or expanded sheets are used. In this case, the lower mass and thermal capacity of the anode, coupled with the higher melting point, often involves widespread damages, with a substantial anodic area that gets entirely destroyed. Even when this doesn't occur, there's the risk that the tip of the dendrite, opening its way across the anode meshes, may get welded thereto, making the subsequent extraction of the cathodes problematic at the time of product harvesting.

In a more advanced generation of anodes, the catalyst-coated titanium mesh is inserted inside an envelope consisting of a permeable separator—for instance a porous sheet of polymeric material or a cation-exchange membrane—fixed to a frame and surmounted by a demister, as described in concurrent patent application WO2013060786. In this case, the growth of dendritic formations towards the anodic surface entails the further risk of piercing of the permeable separator even before they reach the anodic surface, resulting in the inevitable destruction of the device.

It has thus been evidenced the need to provide a technical solution allowing to prevent the harmful consequences resulting from the uncontrolled growth of dendritic deposits on the cathodic surfaces of metal electrowinning cells.

SUMMARY OF THE INVENTION

Various aspects of the invention are set out in the accompanying claims.

Under one aspect, the invention relates to a cell of metal electrowinning comprising an anode with a surface catalytic towards oxygen evolution reaction and a cathode having a surface suitable for electrolytic deposition of metal arranged parallel thereto having a porous electrically conductive screen arranged therebetween and optionally in electrical connection to the anode through a suitably dimensioned resistor, the porous screen having a sensibly lower catalytic activity towards oxygen evolution than the anode. By sensibly lower catalytic activity it is intended herein that the surface of the screen is characterised by an oxygen evolution potential at least 100 mV higher than that of the anode surface in typical process conditions, e.g. under a current density of 450 $A/m^2$.

Besides a high overvoltage with respect to the anodic discharge of oxygen, the screen is characterised by a sufficiently compact but porous structure, such that it allows the passage of the electrolytic solution without interfering with the ionic conduction between the cathode and the anode. The inventors have surprisingly found that by carrying out the electrolysis with a cell design as described, dendrites that are possibly formed are effectively stopped before they reach the facing anode surface so that their growth is essentially blocked. The high anodic overvoltage characterising the surface of the screen prevents it from working as anode during the normal cell operation, allowing the lines of current to keep on reaching the anode surface undisturbed. On the other hand, should a dendrite grow from the cathode surface, it will be able to proceed only until it gets in contact with the screen. Once the contact takes place, a circuit of first species conductors is closed (cathode/dendrite/screen/anodic bus-bar), so that the dendrite growth towards the anode becomes less advantageous. The possible deposition of metal on the surface of the screen can even increase its conductivity to some extent, making it subject to short-circuit current flows. The resistance of the screen can be calibrated to an optimal value through the selection of construction materials, their dimensioning (for example, pitch and diameter of wires in the case of textile structures, diameter and mesh opening in the case of meshes) or the introduction of more or less conductive inserts. In one embodiment, the screen can be made of carbon fabrics of appropriate thickness. In another embodiment, the screen can consist of a mesh or perforated sheet of a corrosion-resistant metal, for example titanium, provided with a coating catalytically inert towards the oxygen evolution reaction. This can have the advantage of relying on the chemical nature and the thickness of the coating to achieve an optimal electrical resistance, leaving the task of imparting the necessary mechanical features to the mesh or perforated plate. In one embodiment, the catalytically inert coating may be based on tin, for example in the form of oxide. Tin oxides above a certain specific loading (over 5 $g/m^2$, typically around 20 $g/m^2$ or more) have proved particularly suitable for imparting an optimal resistance in the absence of catalytic activity towards the anodic evolution of oxygen. Other suitable materials for achieving a catalytically inert coating include tantalum, niobium and titanium, for example in form of oxides. In one embodiment, the restraint of the short circuit current is achieved by mutually connecting the anode and the porous screen through a calibrated resistor, for example having a resistance of 0.01 to 100Ω. An appropriate adjustment of the electrical resistance of the screen allows the device to operate by leveraging the advantages of the invention to the maximum extent: a very low resistance could lead to the drainage of an excessive amount of current, which would somehow diminish the overall yield of copper deposition; on the other hand, a certain conductivity of the screen is useful in order to break the "tip effect"—the main cause of the dendrite growth—and disperse the current flow from the dendrite across the plane, avoiding its growth through the openings of the screen and the consequent risk of mechanical interference in the subsequent procedure of cathode extraction. The optimal point of regulation of the electrical resistance of the screen and the optional resistor in series basically depends on the overall cell size and can be easily calculated by a person skilled in the art.

In one embodiment, the electrowinning cell comprises an additional non-conductive porous separator, positioned between the anode and the screen. This can have the advantage of interposing an ionic conductor between two planar conductors of the first species, establishing a clear separation between the current flow associated to the anode and the one drained by the screen. The non-conductive separator may be a web of insulating material, a mesh of plastic material, an assembly of spacers or a combination of the above elements. In the case of anodes placed inside an envelope consisting of a permeable separator, as described in concurrent patent application WO2013060786, such role can also be carried out by the same separator.

The person skilled in the art will be able to determine the optimal distance of the porous screen from the anode surface depending on the characteristics of the process and of the overall dimensioning of the plant. The inventors have obtained the best results working with cells having anodes spaced apart by 25 to 100 mm from the facing cathode, with the porous screen placed 1-20 mm from the anode.

Under another aspect, the invention relates to an electrolyser for metal electrowinning from an electrolytic bath comprising a stack of cells as hereinbefore described in mutual electrical connection, for example consisting of stacks of cells in parallel, mutually connected in series. As will be apparent to a person skilled in the art, a stack of cells implies that each anode is sandwiched between two facing cathodes, delimiting two adjacent cells with each of its two faces; between each face of the anode and the relevant facing cathode, a porous screen and an optional non-conductive porous separator will then be interleaved.

Under another aspect, the invention relates to a process of copper manufacturing by electrolysis of a solution containing copper in ionic form inside an electrolyser as hereinbefore described.

Some implementations exemplifying the invention will now be described with reference to the attached drawing, which has the sole purpose of illustrating the reciprocal arrangement of the different elements relatively to said particular implementations of the invention; in particular, the drawing is not necessarily drawn to scale.

BRIEF DESCRIPTION OF THE FIGURE

FIG. 1 represents an exploded view of an internal detail of an electrolyser according to one embodiment of the invention.

DETAILED DESCRIPTION OF THE FIGURE

FIG. 1 shows the minimum repeating unit of a modular stack of cells that constitutes an electrolyser according to one embodiment of the invention. Two adjacent electrolytic cells are delimited by central anode (100) and the two cathodes (400) facing the same; between cathodes (400) and the two faces of anode (100), the respective non-conductive porous separators (200) and conductive porous screens (300) are interposed. Conductive porous screens (300) are put in electrical connection with anode (100) by means of connection (500) through anode hanger bar (110) used to suspend anode (100) itself to the anodic bus-bar of the electrolyser (not shown).

The following examples are included to demonstrate particular embodiments of the invention, whose practicability has been largely verified in the claimed range of values. It should be appreciated by those of skill in the art that the compositions and techniques disclosed in the examples which follow represent compositions and techniques discovered by the inventors to function well in the practice of the invention; however, those of skill in the art should, in light of the present disclosure, appreciate that many changes can be made in the specific embodiments which are disclosed and still obtain a like or similar result without departing from the scope of the invention.

EXAMPLE 1

A laboratory test campaign was carried out inside a single electrowinning cell having an overall cross section of 170 mm×170 mm and a height of 1500 mm, containing a cathode and an anode. A 3 mm thick, 150 mm wide and 1000 mm high sheet of AISI 316 stainless steel was used as the cathode; the anode consisted of a titanium grade 1, 2 mm thick, 150 mm wide and 1000 mm high expanded sheet, activated with a coating of mixed oxides of iridium and tantalum. The cathode and anode were positioned vertically face-to-face spaced apart by a distance of 40 mm between the outer surfaces.

Inside the gap between the anode and cathode, a screen consisting of a titanium grade 1, 0.5 mm thick, 150 mm wide and 1000 mm high expanded sheet coated with a layer of 21 $g/m^2$ of tin oxide, was positioned spaced apart by 10 mm from the surface of the anode and electrically connected to the anode through a resistor having 1Ω of electrical resistance.

The cell was operated with an electrolyte containing 160 g/l of $H_2SO_4$ and 50 g/l of copper as $Cu_2SO_4$; a direct current of 67.5 A was supplied, corresponding to a current density of 450 $A/m^2$, with the onset of oxygen evolution at the anode and copper deposition at cathode. During such electrolysis condition it was verified, by observing the development of gas bubbles, as the anodic reaction took place selectively on the anode surface and not on the facing screen, due to the high overpotential of the tin-based coating towards oxygen evolution reaction. This was also confirmed by measuring the electric current across the screen, for which a null value was detected.

During most of the tests it was observed as the copper deposit can be of non-homogeneous and in particular of dendritic nature; in one case for instance, the growth on the cathode surface of a dendrite of about 10 mm diameter, which went on until getting in contact with the screen, was observed. The current of evolution of the dendrite was drained through a circuit consisting of first species conductors: across the contact point, the tin oxide-coated titanium screen, the resistor and the connection to the anodic bus-bar a current of 2 A was detected, corresponding to 13 $A/m^2$, a value well below the current density of electrolysis of 450 $A/m^2$. This shows that the loss of efficiency of the cell is extremely small, particularly if compared to that typical of short-circuits in cells free of protective screen. Such condition remained been stable for about 8 hours without showing significant problems.

COUNTEREXAMPLE 1

The test of Example 1 was repeated in the absence of protective shield interposed between cathode and anode. After about two hours of test, a dendritic formation with a diameter of about 12 mm grew until getting in contact with the anode surface. The passage of current through the thus generated short-circuit was above the 500 A which constituted the limit of the employed rectifier, causing an extensive corrosion of the anodic structure with formation of a hole of diameter corresponding to that of the dendrite body. The test was then forcibly discontinued.

The previous description shall not be intended as limiting the invention, which may be used according to different embodiments without departing from the scopes thereof, and whose extent is solely defined by the appended claims.

Throughout the description and claims of the present application, the term "comprise" and variations thereof such as "comprising" and "comprises" are not intended to exclude the presence of other elements, components or additional process steps.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention before the priority date of each claim of this application.

The invention claimed is:

1. Metal electrowinning cell comprising:

an anode with a catalytic surface towards oxygen evolution reaction;

a cathode suitable for metal deposition from an electrolytic bath, arranged parallel to said anode;

an electrically conductive porous screen interposed between said anode and said cathode, said electrically conductive porous screen is in direct electrical connection with the anode through an anode hanger, said electrically conductive porous screen having an oxygen evolution potential at least 100 mV higher than the oxygen evolution potential of said anode under a current density of 450 $A/m^2$, wherein the electrically conductive porous screen does not interfere with ionic conduction between the anode and the cathode.

2. The cell according to claim 1 wherein said anode consists of a metal substrate, optionally made of titanium, coated with a catalyst containing noble metal oxides.

3. The cell according to claim 1 wherein said porous screen consists of a titanium mesh or punched sheet provided with a coating catalytically inert towards oxygen evolution reaction.

4. The cell according to claim 3 wherein said catalytically inert coating comprises tin oxide at a specific loading higher than 5 $g/m^2$.

5. The cell according to claim 1 wherein said anode and said porous screen are electrically connected through a resistor having an electrical resistance of 0.01 to 100Ω.

6. The cell according to claim 1 further comprising a non-conductive porous separator interposed between said anode and said porous screen.

7. The cell according to claim 1 wherein said anode is inserted within an envelope consisting of a permeable separator surmounted by a demister.

8. The cell according to claim 1 wherein said anode and said cathode are arranged at a mutual distance of 25-100 mm and said anode and said porous screen are arranged at a mutual distance of 1-20 mm.

9. Electrolyser for primary metal extraction from an electrolytic bath comprising a stack of cells according to claim 1 in mutual electrical connection.

10. Process for copper manufacturing starting from a solution containing cuprous and/or cupric ions comprising electrolysing the solution inside an electrolyser according to claim 9.

* * * * *